US009623687B2

(12) United States Patent
Okuda

(10) Patent No.: US 9,623,687 B2
(45) Date of Patent: Apr. 18, 2017

(54) ROLL PAPER CONVEYANCE CONTROL METHOD, ROLL PAPER CONVEYANCE DEVICE, AND PRINTER

(71) Applicant: Seiko Epson Corporation, Tokyo (JP)

(72) Inventor: Yasumichi Okuda, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/593,491

(22) Filed: Jan. 9, 2015

(65) Prior Publication Data

US 2015/0191032 A1 Jul. 9, 2015

(30) Foreign Application Priority Data

Jan. 9, 2014 (JP) ..... 2014-002197
Jul. 24, 2014 (JP) ..... 2014-150486

(51) Int. Cl.
*B41J 15/16* (2006.01)

(52) U.S. Cl.
CPC ..... *B41J 15/165* (2013.01)

(58) Field of Classification Search
CPC B65H 23/195; B65H 23/1955; B65H 23/198; B65H 23/00; B65H 23/18; B65H 23/1806; B41J 13/0009; B41J 13/0018; B41J 13/0027; B41J 13/0036; B41J 13/0045; B41J 15/16; B41J 15/165; B65G 23/00; B65G 23/04; B65G 23/18; B65G 23/44
See application file for complete search history.

(56) References Cited

U.S. PATENT DOCUMENTS 4,177,410 A * 12/1979 Dowd ..... B65H 19/2246 242/412.3
4,485,982 A 12/1984 St. John et al.
5,178,341 A * 1/1993 Ditto ..... B65H 23/198 242/412.2
5,516,058 A * 5/1996 Omokawa ..... B65H 23/198 242/413.6
5,607,245 A * 3/1997 Siwinski ..... B41J 15/16 400/120.01
5,918,830 A * 7/1999 Verajankorva ..... B65H 18/10 242/532.2
6,047,275 A * 4/2000 Jaremko et al. ..... 706/1
6,629,659 B1 * 10/2003 Innala ..... B65H 18/26 242/413.5

(Continued)

FOREIGN PATENT DOCUMENTS

JP 62-083968 A 4/1987
JP 08-133540 A 5/1996

(Continued)

*Primary Examiner* — Matthew Luu
*Assistant Examiner* — Patrick King
(74) *Attorney, Agent, or Firm* — Nutter McClennen & Fish LLP; John J. Penny, Jr.; Joshua L. Rudawitz

(57) ABSTRACT

In a rewind operation in which a supply motor rotates a paper roll to take up slack in the recording paper, movement of a movable member that is pushed in the direction applying tension to the recording paper and moves according to variation in the tension on the recording paper is detected, the supply motor is controlled according to movement of the movable member, and the time required to take up slack in the roll paper is shortened.

6 Claims, 5 Drawing Sheets

(56) References Cited

U.S. PATENT DOCUMENTS

| | | | | |
|---|---|---|---|---|
| 2009/0245912 | A1* | 10/2009 | Igarashi | B41J 11/003 400/618 |
| 2011/0180649 | A1* | 7/2011 | Huang et al. | 242/412.1 |
| 2013/0257963 | A1* | 10/2013 | Yamamoto et al. | 347/16 |
| 2013/0299623 | A1* | 11/2013 | Dollevoet | B65H 35/08 242/534 |

FOREIGN PATENT DOCUMENTS

| | | | |
|---|---|---|---|
| JP | 2003-261121 | A | 9/2003 |
| JP | 2009-046237 | A | 3/2009 |

* cited by examiner

ROLL PAPER CONVEYANCE CONTROL METHOD, ROLL PAPER CONVEYANCE DEVICE, AND PRINTER

This application claims benefit from Japan Patent Application No. 2014-002197 filed on Jan. 9, 2014 and Japan Patent Application No. 2014-150486 filed on Jul. 24, 2014, both of which are incorporated herein by reference in their entireties.

BACKGROUND

1. Technical Field

The present invention relates to a roll paper conveyance control method, a roll paper conveyance device, and a printer.

2. Related Art

Roll paper conveyance devices that set a moving member (movable member) pushed or pulled in a specific direction against the roll paper, apply tension to the roll paper with the moving member in order to take up slack in the roll paper, and print are known from the literature. See, for example, JP-A-S62-83968.

In a device such as the roll paper conveyance device described in JP-A-S62-83968 that removes slack in roll paper by a moving member and then prints, slack must be removed to apply a specific tension to the roll paper before printing. Because printer throughput drops as the time required for the operation that removes slack from the roll paper increases, there is a need to minimize the time required for the operation that removes roll paper slack and improve throughput.

SUMMARY

An objective of at least one embodiment of the present invention is to provide a roll paper conveyance method, a roll paper conveyance device, and a printer that shorten the time required for the operation that removes slack from roll paper.

One aspect of at least one embodiment of the invention is a roll paper conveyance control method of a media conveyance device having a conveyance mechanism for conveying media delivered from a roll, and a media supply motor for rotating the roll, the method including: detecting movement of a movable member that moves according to variation in tension on the media, and controlling the media supply motor according to movement of the movable member, in a rewind operation that rotates the roll using the media supply motor and takes up slack in the media.

Because the media supply motor is controlled during the rewind operation according to movement of the movable member, or more specifically according to change in the tension applied to the media by the movable member, the media supply motor can be driven efficiently reflecting the change in tension during the rewind operation, and the time required for the operation of taking up slack in the roll paper can be shortened.

The roll paper conveyance control method according to another aspect of at least one embodiment of the invention preferably also includes detecting movement of the movable member in the rewind operation, and changing a preset method of controlling the media supply motor according to movement of the movable member.

By changing the method of controlling the media supply motor according to movement of a movable member, this aspect of the invention can drive the media supply motor efficiently reflecting the change in tension, and the time required for the operation of taking up slack in the roll paper can be shortened.

Further preferably, the roll paper conveyance control method of at least one embodiment of the invention also includes increasing the rotational velocity of the media supply motor when a change in the position of the movable member is detected after starting driving the media supply motor in the rewind operation.

More specifically, when the rewind operation starts without knowing the slack in the media, the media supply motor can be driven at a speed at which the paper roll will not rewind the media excessively, and when winding of the media progresses until the position of the movable member reflects the slack in the media, the speed of the media supply motor can be increased to rewind the media at high speed. The media can therefore be rewound at high speed and the time required for the operation taking up slack in the roll paper can be shortened while preventing damage to the movable member due to overwinding the media.

In a roll paper conveyance control method according to another aspect of at least one embodiment of the invention, a first control method and a second control method in which the method of control is different from the first control method are previously set as methods of controlling the media supply motor; and the roll paper conveyance control method further includes driving the media supply motor based on the second control method when a change in the position of the movable member is detected in the rewind operation after starting driving of the media supply motor based on the first control method.

By changing the control method of the media supply motor from a first control method to a second control method when a change in the position of the movable member is detected during the rewind operation, this aspect of the invention can rewind the media at high speed and shorten the time required for the operation taking up slack in the roll paper while preventing damage to the movable member due to overwinding the media.

Yet further preferably, the rewind operation is an operation of the media supply motor rotating the roll and positioning the media supply motor to a target rewind position; the first control method and the second control method define a relationship between the distance of separation between the position of the movable member and the target rewind position, and a control amount of the media supply motor; and the control amount of the media supply motor at any same distance of separation is greater in the second control method than in the first control method.

By changing the control method of the media supply motor from a first control method to a second control method when a change in the position of the movable member is detected during the rewind operation, this aspect of the invention can prevent damage to the movable member due to overwinding the media, and by driving the media supply motor at a control amount based on the distance of separation, can rewind the media at high speed and shorten the time required for the operation taking up slack in the roll paper.

In the roll paper conveyance control method according to another aspect of the invention, the distance of separation and the control amount of the media supply motor are proportional in the first control method and the second control method; the first control method and the second control method define a proportional constant related to the proportional relationship of the distance of separation and the control amount of the media supply motor, and the proportional constant of the second control method is greater than the proportional constant of the first control method; and the control method further includes changing the method of controlling the media supply motor from the first control method to the second control method, and changing the target rewind position to a position closer to the position of the movable member, when a change in the position of the movable member is detected in the rewind operation.

By changing the control method of the media supply motor from a first control method to a second control method that define a proportional constant related to the proportional relationship of the distance of separation and the control amount of the media supply motor when change in the position of the movable member is detected to change in the rewind operation, this aspect of the invention can prevent damage to the movable member due to overwinding the media, and by driving the media supply motor at a control amount based on the distance of separation, can rewind the media at high speed and shorten the time required for the operation taking up slack in the roll paper.

In a roll paper conveyance control method according to another aspect of at least one embodiment of the invention, the rewind operation is an operation of the media supply motor rotating the roll and positioning the media supply motor to a target rewind position; and the media supply motor is driven by PID control based on the positional deviation between the position of the movable member and the target rewind position when a change in the position of the movable member is detected after starting driving the media supply motor in the rewind operation.

When winding the media progresses after the rewind operation starts until the position of the movable member reflects the slack in the media, this aspect of the invention drives the media supply motor by PID control based on the positional deviation of the position of the movable member to the target rewind position, and controls the movable member to the target rewind position.

Further preferably, the roll paper conveyance control method includes starting conveyance of the media by the conveyance mechanism when a set times passes after the rewind operation ends.

This aspect of the invention enables starting of media conveyance by the conveyance mechanism after waiting until the media tension stabilizes after the rewind operation ends.

Another aspect of at least one embodiment of the invention is a roll paper conveyance device including: a conveyance mechanism that conveys media delivered from a media roll; a media supply motor that rotates the roll; a movable member that is pushed in the direction applying tension to the media and moves according to variation in the tension on the media; and a control unit that detects movement of the movable member and controls the media supply motor according to movement of the movable member in a rewind operation that rotates the roll by the media supply motor and takes up slack in the media.

Because the media supply motor is controlled during the rewind operation according to movement of the movable member, or more specifically according to change in the tension applied to the media by the movable member, the media supply motor can be driven efficiently reflecting the change in tension during the rewind operation, and the time required for the operation of taking up slack in the roll paper can be shortened.

Another aspect of at least one embodiment of the invention is a printer including: a conveyance mechanism that conveys media delivered from a media roll; a print mechanism that prints on the media conveyed by the conveyance mechanism; a media supply motor that rotates the roll; a movable member that is pushed in the direction of applying tension to the media and moves according to a variation in the tension on the media; and a control unit that detects movement of the movable member and controls the media supply motor according to movement of the movable member in a rewind operation that rotates the roll by the media supply motor and takes up slack in the media.

Because the media supply motor is controlled during the rewind operation according to movement of the movable member, or more specifically according to change in the tension applied to the media by the movable member, the media supply motor can be driven efficiently reflecting the change in tension during the rewind operation, and the time required for the operation of taking up slack in the roll paper can be shortened.

Another aspect of at least one embodiment of the invention is a media conveyance control method of a media conveyance device having a conveyance mechanism that conveys a continuous medium delivered from a roll, and a media supply motor that rotates the roll, including steps of: disposing a movable member that is pushed by a spring in the direction of applying tension to the media and is able to move following a change in the tension on the media between the paper roll and the conveyance mechanism; when the movable member is positioned to one end of its movable range by the force of the spring, executing a rewind operation of driving the media supply motor to rotate the paper roll to set the movable member to a target rewind position set in the movable range at a position other than said one end; and in the rewind operation, continuously or intermittently acquiring the distance of separation between the target rewind position and the position to which the movable member moves, and driving the media supply motor based on a control function in which the distance of separation and the control amount of the media supply motor are directly proportional, setting plural control functions of different proportional constants as the control function, and changing the control function based on the position of the movable member.

This aspect of the invention changes the control function for driving the media supply motor during the rewind operation. Because the control function is a directly proportional relationship between the control amount of the media supply motor and the distance from the position of the movable member to the target rewind position, the control amount of the media supply motor can be changed according to the distance of separation when the control function changes, and the speed of the media supply motor can be changed.

Therefore, when the rewind operation starts without knowing the slack in the media, the media supply motor can be driven at a speed at which the paper roll will not rewind the media excessively, and when winding the media moves from the one end of the movable range to where the position of the movable member reflects the slack in the media, the control function can be changed to drive the media supply motor faster and set the movable member to the target rewind position. The rewind operation can therefore be completed in less time than if the media supply motor is driven continuously at the speed at which the roll will not overwind the media.

Overwinding the media by driving the media supply motor at high speed can therefore be avoided even without providing a large area for movement of the movable member, thereby preventing the device from. Note that the control amount of the media supply motor in this example is the duty when the media supply motor is driven by PWM control.

In another aspect of at least one embodiment of the invention, a first control function of a first proportional constant, and a second control function of a second proportional constant that is greater than the first proportional constant, are provided as control functions. When the rewind operation starts, the media supply motor is driven using the first control function, and when the position of the movable member changes, the first control function changes to the second control function to drive the media supply motor.

Therefore, when the rewind operation starts without knowing the slack in the media, the media conveyance motor can be driven at a first speed at which the paper roll will not rewind the media excessively, and after the movable member moves from the one end of the movable range to where the position of the movable member reflects the slack in the media, the media supply motor can be easily driven at a second speed that is greater than the first speed.

In this aspect of the invention, the setting for the target rewind position can be changed simultaneously with changing the control function. Because the distance of separation changes if the setting of the target rewind position changes (if the target rewind position is moved to a different position in the movable range of the movable member), the control amount of the media conveyance motor changes. Therefore, by changing the target rewind position, the speed of the media conveyance motor can be adjusted. Therefore, if the setting of the target rewind position is changed simultaneously with changing the control function, sudden change in the speed of the media conveyance motor can be suppressed when the control function changes.

Further alternatively, after the position of the movable member changes, the media supply motor may be driven by PID control based on the positional deviation of the position of the movable member to the target rewind position. More specifically, because the position of the movable member reflects slack in the media when the movable member moves from the one end of the movable range, the media supply motor can be driven by PID control based on the positional deviation of the movable member to the target position, and the movable member can be set to the target rewind position.

When the movable member is set to the target rewind position by the rewind operation, conveyance of the media by the conveyance mechanism preferably starts after waiting for a preset time to pass. More specifically, media conveyance by the conveyance mechanism preferably starts after waiting for the tension on the media to stabilize after the rewind operation ends.

Another aspect of at least one embodiment of the invention is a printer having: a conveyance mechanism that conveys continuous media delivered from a paper roll; a media supply motor that rotates the paper roll; a movable member that is disposed between the paper roll and the conveyance mechanism and can move following change in tension on the media; a spring that pushes the movable member in the direction of applying tension to the media; a detector that continuously or intermittently detects the position of the movable member; and a rewind operation control unit that, when the movable member is positioned at one end of the movable range by the force of the spring, drives the media supply motor in a rewind operation that rotates the paper roll to set the movable member to a target rewind position set to a position other than the one end in the movable range. The rewind operation control unit includes a distance of separation acquisition unit that continuously or intermittently gets the distance the position of the movable member is separated from the target rewind position; a storage unit that stores a plurality of control functions as control functions in which the control amount of the media supply motor and the distance of separation are directly proportional; a drive control unit that drives the media supply motor based on the control function; and a control function changing unit that changes the control function whereby the drive control unit drives the media supply motor based on the position of the movable member.

In this aspect of the invention the control function changing unit changes the control function used by the drive control unit to drive the media supply motor during the media rewind operation. Because the control function is a directly proportional relationship between the control amount of the media supply motor and the distance from the position of the movable member to the target rewind position, the control amount of the media supply motor can be changed according to the distance of separation when the control function changes, and the speed of the media supply motor can be changed.

Therefore, when the rewind operation starts without knowing the slack in the media, the media supply motor can be driven at a speed at which the paper roll will not rewind the media excessively, and when winding the media moves from the one end of the movable range to where the position of the movable member reflects the slack in the media, the control function can be changed to drive the media supply motor faster and set the movable member to the target rewind position. The rewind operation can therefore be completed in less time than if the media supply motor is driven continuously at the speed at which the roll will not overwind the media.

Overwinding the media by driving the media supply motor at high speed can therefore be avoided even without providing a large area for movement of the movable member, thereby preventing the device from becoming large can therefore be prevented. Note that the control amount of the media supply motor in this example is the duty when the media supply motor is driven by PWM control.

In another aspect of at least one embodiment of the invention, a first control function of a first proportional constant, and a second control function of a second proportional constant that is greater than the first proportional constant, are used as the control functions. The drive control unit drives the media supply motor based on the first control function when the rewind operation starts, and when the position of the movable member changes, the control function changing unit can change the control function whereby the drive control unit drives the media supply motor from the first control function changes to the second control function.

Therefore, when the rewind operation starts without knowing the slack in the media, the media conveyance motor can be driven at a first speed at which the paper roll will not rewind the media excessively, and after the movable member moves from the one end of the movable range to where the position of the movable member reflects the slack in the media, the media supply motor can be easily driven at a second speed that is greater than the first speed.

In another aspect of at least one embodiment of the invention, the control function changing unit can change the setting for the target rewind position simultaneously with changing the control function. Because the distance of separation changes if the setting of the target rewind position changes, the control amount of the media conveyance motor changes. Therefore, by changing the target rewind position, the speed of the media conveyance motor can be adjusted.

Therefore, if the setting of the target rewind position is changed simultaneously with changing the control function, sudden change in the speed of the media conveyance motor when the control function changes can be suppressed.

Further alternatively, after the position of the movable member changes, the drive control unit can drive the media supply motor by PID control based on the distance of separation. More specifically, because the position of the movable member reflects slack in the media when the movable member moves from the one end of the movable range, the media supply motor can be driven by PID control based on the positional deviation of the movable member to the target position, and the movable member can be set to the target rewind position.

Further preferably, this aspect of the invention also has a conveyance control unit that starts conveyance of the media by the conveyance mechanism after waiting for a preset time to pass from when the movable member is set to the target rewind position by the rewind operation. More specifically, media conveyance by the conveyance mechanism may start after waiting for the tension on the media to stabilize after the rewind operation ends.

Other objects and attainments together with a fuller understanding of the invention will become apparent and appreciated by referring to the following description and claims taken in conjunction with the accompanying drawings.

DESCRIPTION OF EMBODIMENTS

A preferred embodiment of a printer according to the present invention is described below with reference to the accompanying figures.

Figure 1:
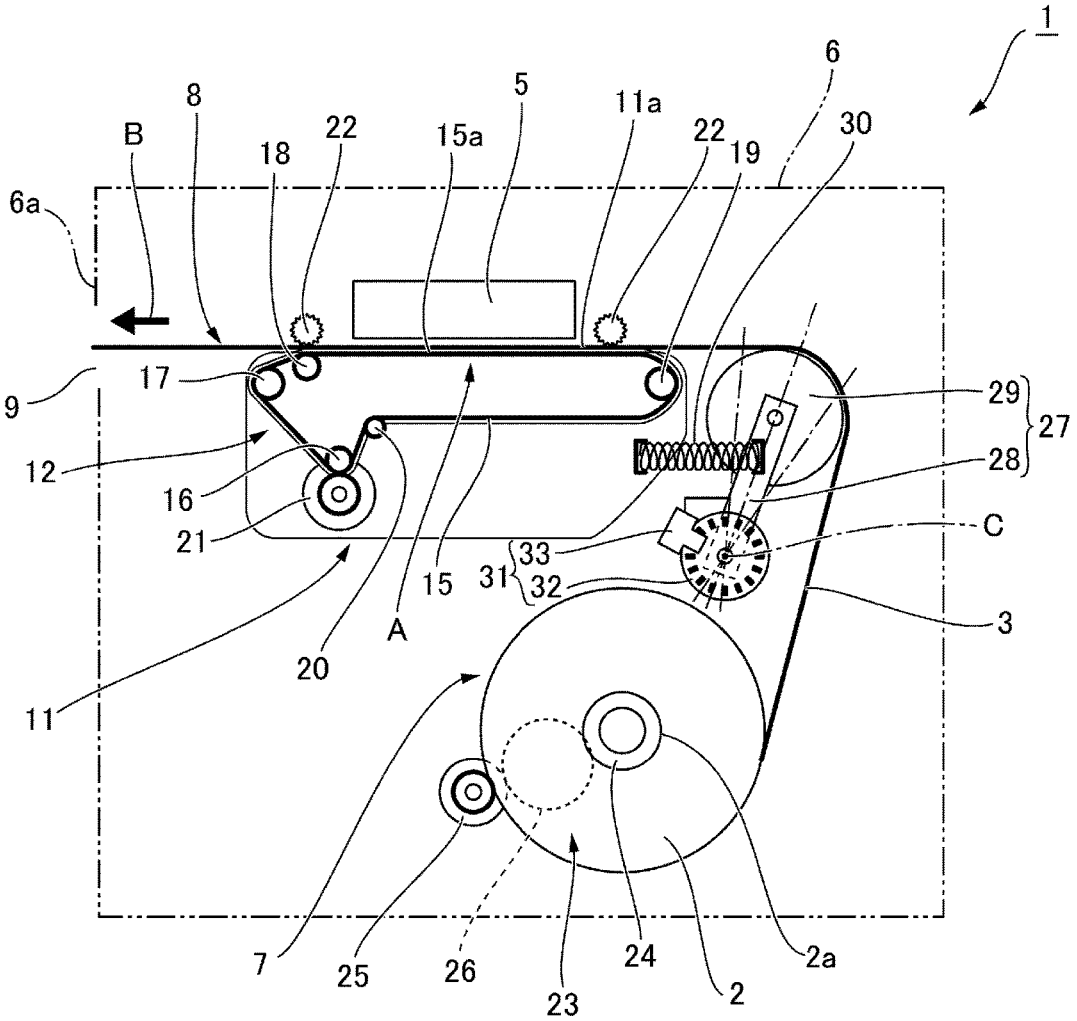
FIG. 1 illustrates the basic configuration of a printer according to the invention.
Figure 2:
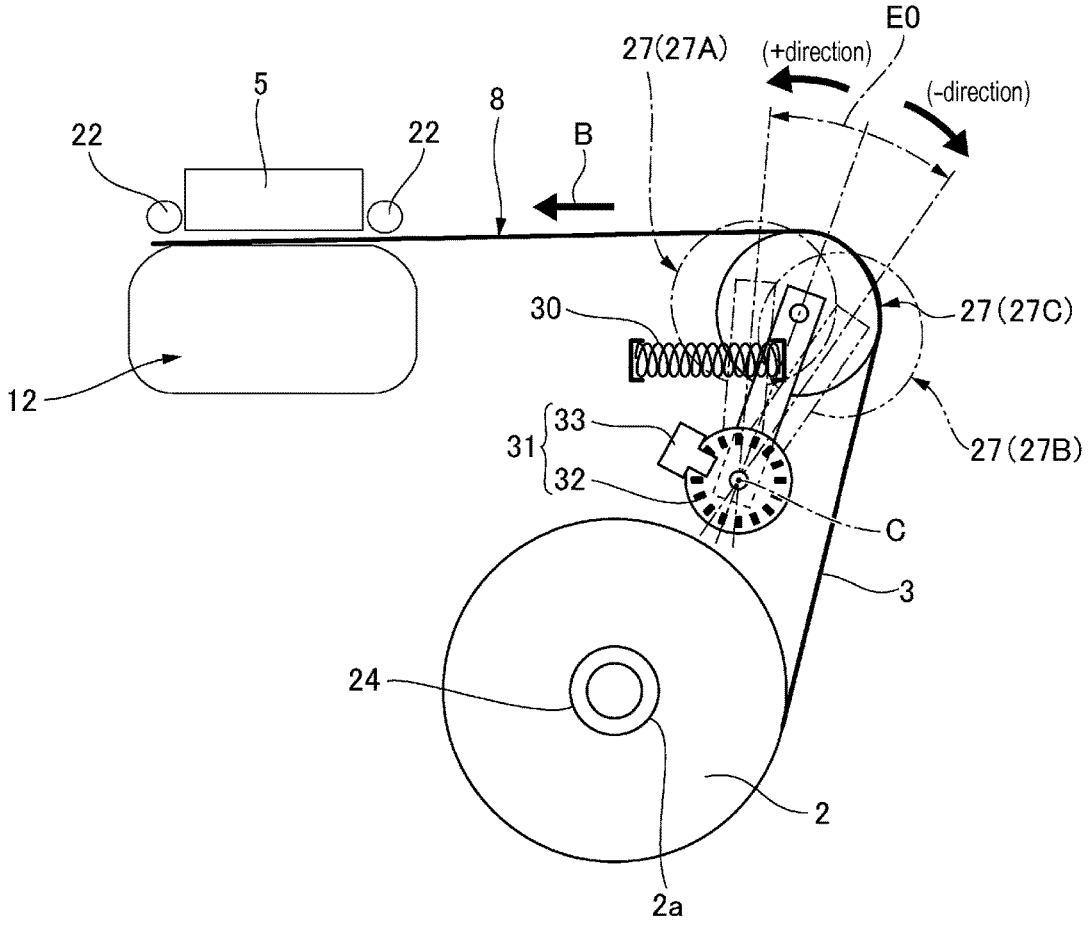
FIG. 2 illustrates the allowable movement range of the movable member.

FIG. 1 illustrates the basic configuration of a printer according to the invention. FIG. 2 illustrates the allowable movement range of the movable member.

The printer 1 (roll paper conveyance device) in this example is a roll paper printer that prints on continuous recording paper (media) 3 delivered from a paper roll (roll) 2. The printer 1 in this example is also a line printer having an inkjet line head as the printhead 5 (print mechanism). As shown in FIG. 1, the printer 1 has a roll paper compartment 7 that holds the paper roll 2, and a paper conveyance path 8 for conveying the recording paper 3 pulled from the paper roll 2, inside the printer case 6 indicated by an imaginary line. The paper conveyance path 8 goes from the roll paper compartment 7, past the print position A of the printhead 5, and to the paper exit 9 disposed at the top part of the front 6*a* of the printer case 6. The printhead 5 is disposed above the roll paper compartment 7.

A platen unit 11 is disposed below the printhead 5. The platen unit 11 has a platen surface 11*a* opposite the printhead 5 with a specific gap therebetween. The print position A is determined by the platen surface 11*a*. A conveyance mechanism 12 for conveying the recording paper 3 through the paper conveyance path 8 is also disposed in the platen unit 11.

The conveyance mechanism 12 includes an endless conveyance belt 15, a belt drive roller 16 on which the conveyance belt 15 is mounted, and a plurality of guide rollers 17 to 20. The conveyance mechanism 12 also includes a conveyance motor 21 as the drive source. Drive power from the conveyance motor 21 is transferred to the belt drive roller 16, and the conveyance belt 15 turns as a result of rotationally driving the belt drive roller 16.

The conveyance belt 15 has a flat belt portion 15*a* extending horizontally over the top of the platen unit 11. The flat belt portion 15*a* defines the platen surface 11*a*. Pinch rollers 22 are disposed to the flat belt portion 15*a* at the upstream end and the downstream end of the conveyance direction B. The pinch rollers 22 are pressed toward the flat belt portion 15*a*, and the recording paper 3 is conveyed and held between the pinch rollers 22 and the flat belt portion 15*a*.

A media supply mechanism 23 is disposed in the roll paper compartment 7. The media supply mechanism 23 includes a roll paper spindle 24 that holds the core 2*a* of the paper roll 2, and a supply motor (media supply motor) 25 for rotating the roll paper spindle 24. The supply motor 25 is driven by PWM control, and drive power therefrom is transferred through a gear train 26 to the roll paper spindle 24. When the supply motor 25 is driven and the roll paper spindle 24 turns, the paper roll 2 mounted on the roll paper spindle 24 rotates in unison with the roll paper spindle 24.

A movable member 27 that can move following a change in the tension on the recording paper 3 is disposed to the paper conveyance path 8 between the roll paper compartment 7 and the conveyance mechanism 12.

The movable member 27 includes a slack lever 28 supported pivotably at the bottom end part around an axis of rotation C, which extends parallel to the width of the recording paper 3; and a slack roller 29 attached rotatably to the top end part of the slack lever 28. The slack lever 28 is pushed to the back (to the right in FIGS. 1 and 2) with a specific force by a compression spring (urging member) 30. More specifically, the movable member 27 is pushed by the compression spring 30 in the direction applying tension to the recording paper 3.

The recording paper 3 pulled up from the paper roll 2 stored in the roll paper compartment 7 travels around the slack roller 29, and continues to the front after curving along the slack roller 29.

Note that instead of using a compression spring 30, a torsion spring may be disposed on the slack lever 28 at a position around the axis of rotation C such that the slack lever 28 is pushed by the torsion spring in the direction moving the slack roller 29 to the back (to the right in FIGS. 1 and 2).

A rotary encoder (detector) 31 that senses the position of the movable member 27 (slack lever 28) is disposed near the axis of rotation C of the slack lever 28. The rotary encoder 31 includes an encoder disc 32 that rotates in unison with the slack lever 28 around the axis of rotation C, and a detection unit 33 disposed at a fixed position opposite the outside edge of the encoder disc 32. The current position of the movable member 27 is output from the detection unit 33.

As shown in FIG. 2, the movable member 27 moves between a tension limit position 27A where the slack lever 28 is raised to a nearly vertical position, and a slack limit position 27B where the slack lever 28 is at an angle towards the back of the printer. The distance between the tension limit position 27A and the slack limit position 27B is therefore the allowable movement range (movable range) E0 of the movable member 27. The tension limit position 27A is closer to the front of the printer than the slack limit position 27B. A target position 27C is set at a position corresponding to the middle of the direction of movement of the movable member 27 through the allowable movement range E0. The target position 27C is the target for positioning the movable member 27 while the recording paper 3 is being conveyed. A target rewind position for positioning the movable member 27 when conveyance of the recording paper 3 starts is also set in the allowable movement range E0.

Control System

Figure 3:
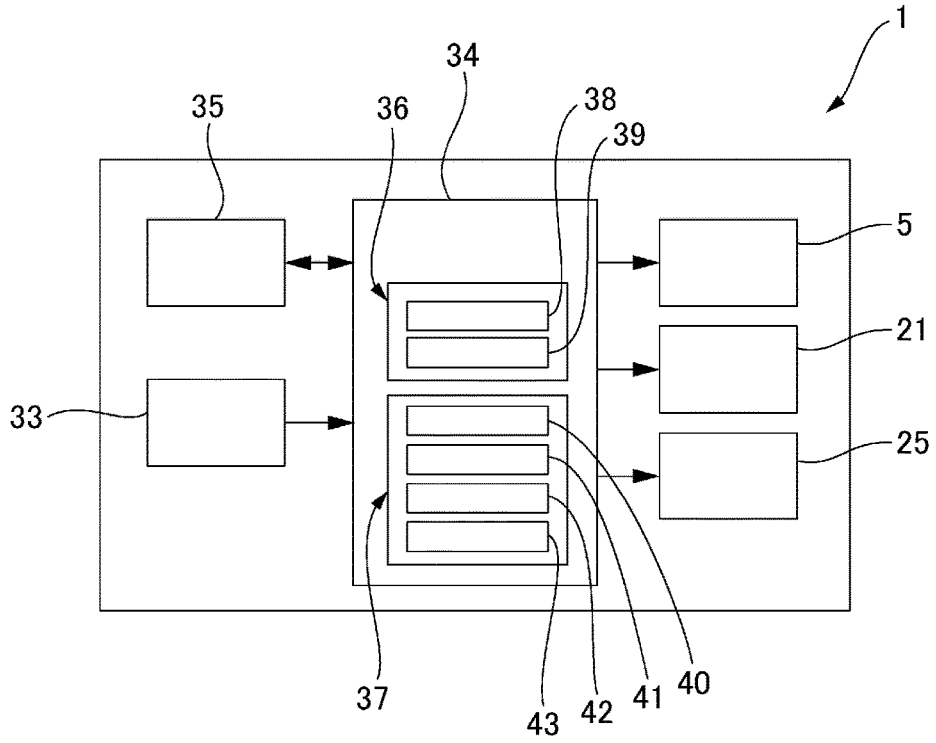
FIG. 3 is a basic block diagram of the control system of the printer shown in FIG. 1.
Figure 4:
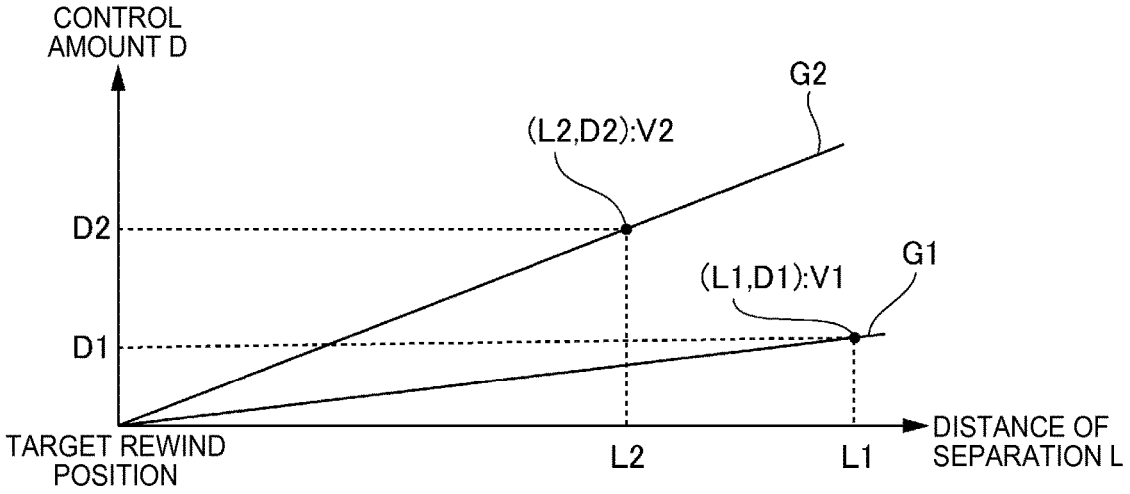
FIG. 4 is a graph of gain used for controlling the supply motor.

FIG. 3 is a block diagram showing main parts in the control system of the printer 1. FIG. 4 is a graph of the gain for controlling the supply motor 25.

As shown in FIG. 3, the control system of the printer 1 is configured around a printer control unit 34 including a CPU and memory. A communication unit 35 that communicatively connects to an external device, and the detection unit 33 of the rotary encoder 31, are connected to the printer control unit 34. The printhead 5, conveyance motor 21, and supply motor 25 connect through drivers not shown to the output side of the printer control unit 34.

When print data is supplied from an external device through the communication unit 35, the printer control unit 34 controls driving the conveyance motor 21 and printhead 5 to print. More specifically, the printer control unit 34 controls driving the conveyance motor 21 to convey the recording paper 3 at a specific speed by means of the conveyance mechanism 12, and controls driving the printhead 5 to print the print data on the recording paper 3 while passing the print position A.

The printer control unit 34 also includes a conveyance control unit 36 and a rewind control unit 37 as a control unit that controls driving the supply motor 25.

The conveyance control unit 36 controls the driving of the supply motor 25 when the recording paper 3 is conveyed by the conveyance mechanism 12 to rotate the paper roll 2, thereby supplying recording paper 3 from the paper roll 2 or rewinding the recording paper 3 onto the paper roll 2, thereby setting the movable member 27 to the target position 27C and suppressing fluctuation in the tension on the recording paper 3.

The conveyance control unit 36 also includes a deviation acquisition unit 38 and a PID control unit 39.

A value indicating the current position of the movable member 27 is input from the detection unit 33 to the deviation acquisition unit 38. The deviation acquisition unit 38 subtracts the value indicating the current position of the movable member 27 from the value indicating the target position 27C at a predetermined specific period, and acquires the positional deviation. The value representing the target position 27C is previously stored in memory, for example. In this example, the period for determining the positional deviation is 1 ms.

The PID control unit 39 controls the driving of the supply motor 25 by controlling the duty of the PWM signal that drives the supply motor 25. Based on the positional deviation continuously acquired by the deviation acquisition unit 38, the PID control unit 39 applies feedback control to the supply motor 25 to reduce the positional deviation and return the movable member 27 to the target position 27C. More specifically, the conveyance control unit 36 drives the supply motor 25 by PID control during conveyance of the recording paper 3 by the conveyance mechanism 12 to position the movable member 27 to the target position 27C.

If the movable member 27 is set to the slack limit position 27B (one end of the range of movement) by the force of the compression spring 30 before conveyance of the recording paper 3 starts, the rewind control unit 37 drives the supply motor 25 in a rewind operation that rotates the paper roll 2 and positions the movable member 27 to a specific target rewind position. Note that the target rewind position is set to a position other than the slack limit position 27B. In this example, the target rewind position is changed from a first target rewind position to a second target rewind position during the rewind operation (the target position moves). In this example, the first target rewind position is the tension limit position 27A, and the second target rewind position is the target position 27C. The first target rewind position is set to a position where the calculated gap distance L is longer than at the second target rewind position. For example, the first target rewind position may be set to a desirable position closer to the tension limit position 27A than the target position 27C.

The rewind control unit 37 includes a gap distance acquisition unit 40, memory (storage unit) such as ROM 41, a drive control unit 42, and a gain changing unit (control function) 43.

A value indicating the current position of the movable member 27 is input from the detection unit 33 to the gap distance acquisition unit 40. While the recording paper 3 is being rewound, the gap distance acquisition unit 40 subtracts the value indicating the current position of the movable member 27 from the currently set target rewind position (first target rewind position or second target rewind position) at a specific predetermined period, and acquires the gap distance L. The period for acquiring the gap distance L in this example is 1 ms. The value indicating the first target rewind position and the value indicating the second target rewind position are previously stored in memory 41.

The gain G (control method, control function) for controlling driving of the supply motor 25 is also recorded and stored in memory 41. As shown in FIG. 4, this gain G is a function related to the directly proportional relationship between the gap distance L and the control amount D of the supply motor 25. More specifically, the gain G is in a relationship where the control amount D of the supply motor 25 increases at a constant rate as the gap distance L increases (separation becomes farther).

This example uses two gain G values, a first gain G1 (first control method) and a second gain G2 (second control method). The proportional constant of the second gain G2 is greater than the proportional constant of the first gain G1. In this example, the control amount D of the supply motor 25 is the duty of the PWM drive signal applied to the supply motor 25. The increase or decrease in the duty corresponds to the speed (rotational velocity) and torque of the supply motor 25 being driven. More specifically, if the duty increases, the supply motor 25 is driven at a faster speed, and torque rises. If duty decreases, the speed of the supply motor 25 slows and torque decreases.

The drive control unit 42 drives the supply motor 25 based on the gain G stored in the memory 41 during the recording paper 3 rewind operation. When the rewind operation starts, the drive control unit 42 drives the supply motor 25 using the first gain G1. When the rewind operation starts, the drive control unit 42 also sets the target rewind position to the first target rewind position (tension limit position 27A) and drives the supply motor 25.

The gain changing unit 43 changes the gain G whereby the drive control unit 42 drives the supply motor 25 based on the position of the movable member 27. In this example, the gain changing unit 43 changes the gain G whereby the drive control unit 42 drives the supply motor 25 from the first gain G1 to the second gain G2 if the position of the movable member 27 changes. More specifically, if the movable member 27 moves from the slack limit position 27B toward the tension limit position 27A, the gain changing unit 43 changes the gain G from the first gain G1 to the second gain G2. Simultaneously with changing the gain G1, G2, the gain changing unit 43 also changes the setting of the target rewind position from the target rewind position printer 1 (tension limit position 27A) to the second target rewind position (target position 27C). More specifically, the target rewind position changes to a position closer to the movable member.

Figure 5:
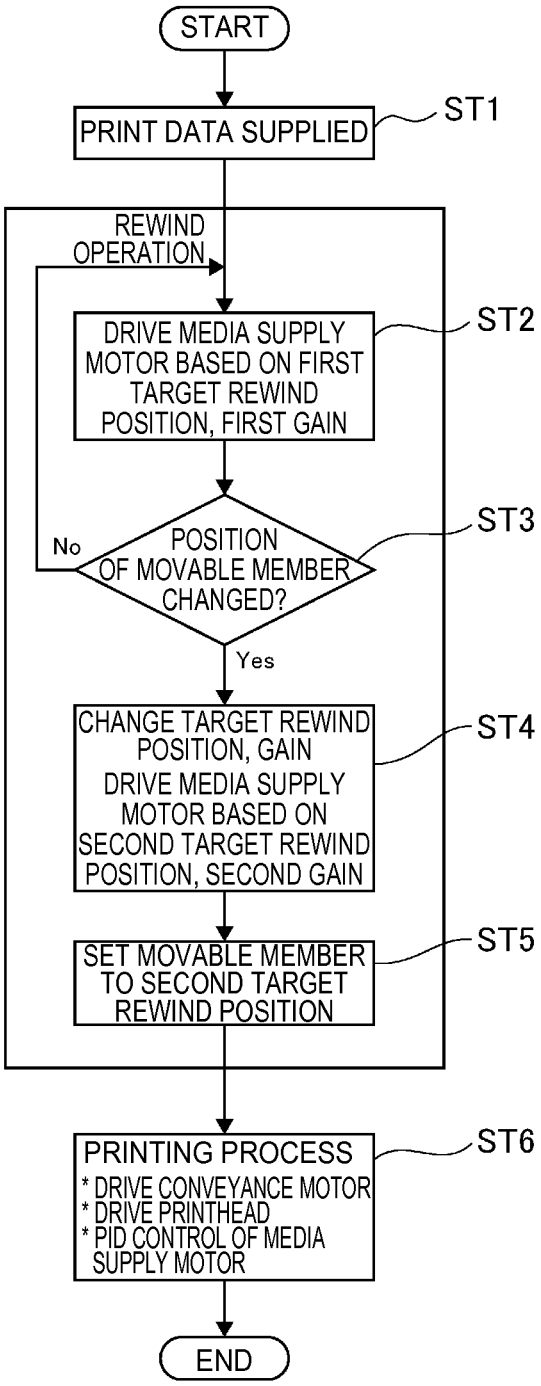
FIG. 5 is a flow chart of the printing process of the printer.
Figure 6A:
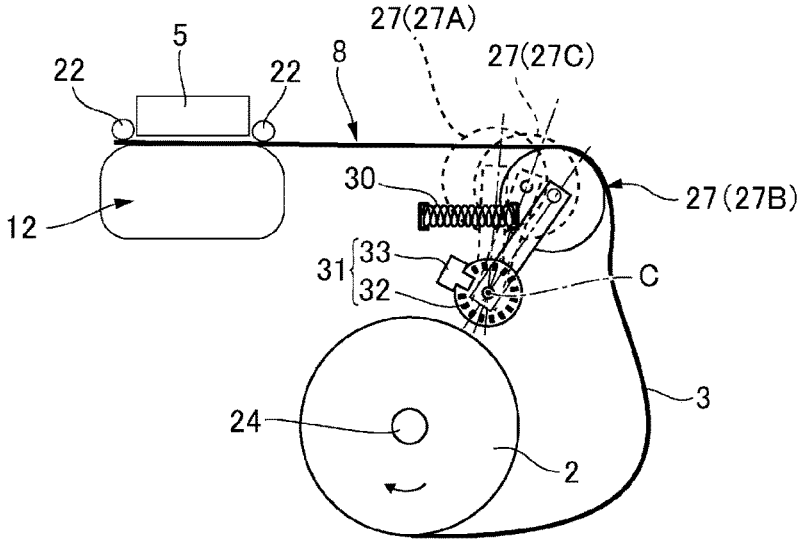
FIGS. 6A-6C illustrate the rewinding (take-up) operation.
Figure 6B:
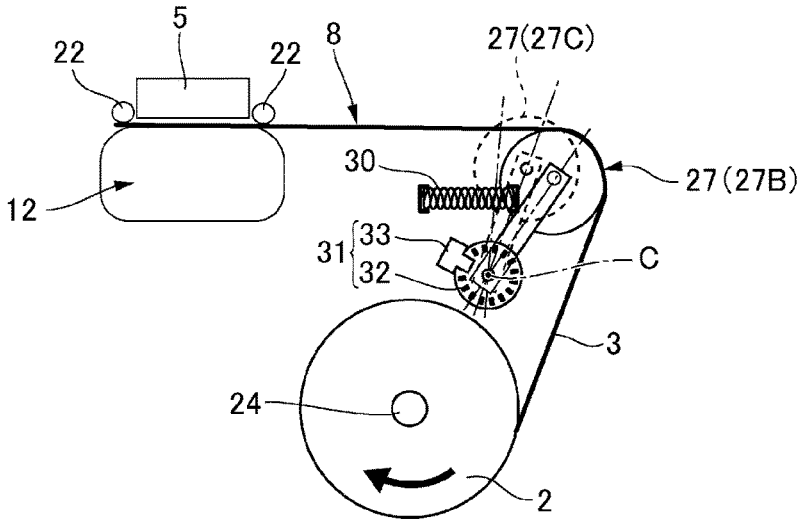
Figure 6C:
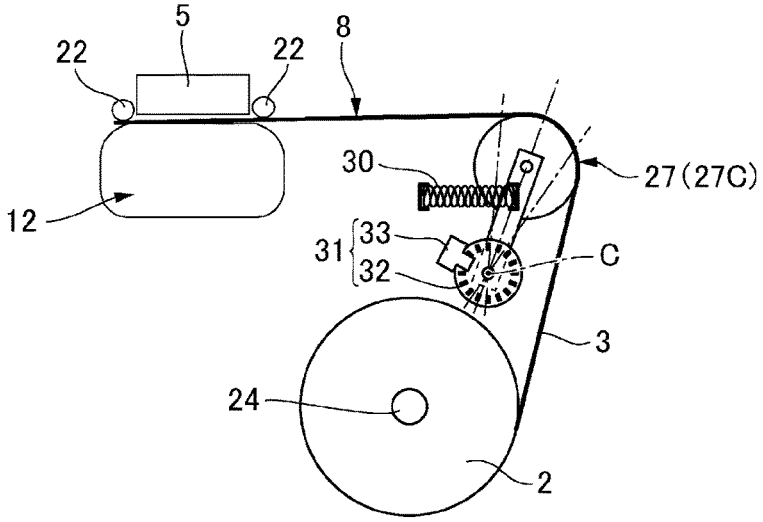

Operation in the printing process of the printer 1 is described next with reference to FIG. 4 to FIGS. 6A-6C. FIG. 5 is a flow chart of the operation of the printer 1 in the printing process. FIGS. 6A-6C illustrate the rewind operation. FIG. 6A shows when there is slack in the recording paper 3 between the conveyance mechanism 12 and the paper roll 2, FIG. 6B shows the moment when the movable member 27 moves from the slack limit position 27B to the tension limit position 27A side, and FIG. 6C shows when the movable member 27 is at the second target rewind position.

To print, the recording paper 3 is pulled up from the paper roll 2 mounted on the roll paper spindle 24, passed around the slack roller 29 of the movable member 27 to the front, and then set in the paper conveyance path 8 passing the print position A. In this example, as shown in FIG. 6A, the recording paper 3 is pinched by the pinch rollers 22 and there is slack in the recording paper 3 between the conveyance mechanism 12 and the paper roll 2 after the recording paper 3 is set, and the movable member 27 is pushed to the slack limit position 27B by the force of the compression spring 30.

As shown in FIG. 5, when print data is supplied from an external device after the recording paper 3 is loaded on the paper conveyance path 8 (step ST1), the rewind control unit 37 drives the supply motor 25 in the rewind operation to turn the paper roll 2 and set the movable member 27 to the target rewind position.

The gap distance acquisition unit 40 acquires the gap distance L at a regular period during this rewind operation. The drive control unit 42 also sets the target rewind position to the first target rewind position (tension limit position 27A), and starts driving the supply motor 25 using the first gain G1 (step ST2). As shown in FIG. 4, the gap distance L when the rewind operation starts is L1. Therefore, when the rewind operation starts, the supply motor 25 is driven at duty D1 (control amount D1). By driving the supply motor 25 at duty D1, the supply motor 25 is driven at a first velocity V1 at which the paper roll 2 will not overwind the recording paper 3.

As shown in FIG. 4, when driving the supply motor 25 with the first gain G1, the control amount D of the supply motor 25 for the same gap distance L is less and the torque of the supply motor 25 at the control amount D is lower than when driving the supply motor 25 at second gain G2. Therefore, by setting the tension limit position 27A as the first target rewind position when the rewind operation starts, the gap distance L acquired by the gap distance acquisition unit 40 is large and the supply motor 25 can therefore produce enough torque to rewind the recording paper 3 in resistance to the force of the compression spring 30.

The position of the movable member 27 thereafter does not change until the movable member 27 is moved from the slack limit position 27B toward the tension limit position 27A by rewinding the recording paper 3 onto the paper roll 2 (step ST3 returns NO). The supply motor 25 therefore continues being driven at duty D1.

When the movable member 27 is moved from the slack limit position 27B toward the tension limit position 27A by rewinding the recording paper 3 onto the paper roll 2 (step ST3 returns YES) as shown in FIG. 6B, the position of the movable member 27 changes. When the position of the movable member 27 changes, the gain changing unit 43 changes the gain G at which the drive control unit 42 drives the supply motor 25 from the first gain G1 to the second gain G2. The target rewind position is also changed from the first target rewind position (tension limit position 27A) to the second target rewind position (target position 27C) (step ST4).

When the gain G and the target rewind position are changed in this example, the gap distance L (the distance between the current position of the movable member 27 and the second target position 27C) becomes L2. The supply motor 25 is therefore driven at duty D2 (control amount D2) as shown in FIG. 4 immediately after the current position of the movable member 27 changes. By driving the supply motor 25 at duty D2, the supply motor 25 is driven at a second velocity V2 that is greater than the first velocity V1.

When driving the supply motor 25 with the second gain G2, the control amount D of the supply motor 25 for the same gap distance L is greater and the torque of the supply motor 25 at the control amount D is greater than when driving the supply motor 25 at first gain G1. Therefore, by rewinding the recording paper 3 onto the paper roll 2, the movable member 27 moves closer to the second target rewind position, and the sequentially acquired gap distance L becomes shorter, but the supply motor 25 produces just enough torque to rewind the recording paper 3 in resistance to the force of the compression spring 30.

Thereafter, the supply motor 25 controls driving based on the second gain G2 and the gap distance L continuously acquired by the gap distance acquisition unit 40. As a result, the movable member 27 is held at the second target rewind position (target position 27C) shown in FIG. 6C, and the tension on the recording paper 3 is held at a desirable tension level (step ST5).

When the movable member 27 is at the target position 27C, the printer control unit 34 starts printing the print data (step ST6). During printing while the recording paper 3 is conveyed, the conveyance control unit 36 gets the positional deviation of the movable member 27 to the target position 27C at a regular period, calculates the P parameter, I parameter, and D parameter for PID control based on the continuously acquired positional deviation, and drives the supply motor 25 by PID control. As a result, variation in tension on the recording paper 3 is suppressed, and variation in the conveyance speed of the recording paper 3 due to variation in the tension is suppressed.

For example, when the recording paper 3 is pulled in the opposite direction as the conveyance direction B due to the inertia of the paper roll 2 while conveying the recording paper 3, the movable member 27 pivots from the target position 27C toward the tension limit position 27A. In this event, as shown in FIG. 2, the positional deviation increases in the positive (+) direction (the direction increasing tension), and the supply motor 25 is therefore driven so that recording paper 3 is delivered from the paper roll 2 in order to reduce the positional deviation. As a result, the movable member 27 returns to the target position 27C, and variation in the tension on the recording paper 3 is suppressed.

When the recording paper 3 is delivered in the conveyance direction B more quickly than the conveyance speed due to the inertia of the paper roll 2, for example, during conveyance of the recording paper 3, the movable member 27 pivots from the target position 27C toward the slack limit position 27B. In this event, as shown in FIG. 2, the positional deviation increases in the negative (−) direction (the direction decreasing tension), and the supply motor 25 is therefore driven so that recording paper 3 is taken up by the paper roll 2 in order to reduce the positional deviation. As a result, the movable member 27 returns to the target position 27C, and variation in the tension on the recording paper 3 is suppressed.

When printing ends, the recording paper 3 is conveyed until the printed portion is discharged to the outside of the paper exit 9. Driving the conveyance motor 21 then stops, and conveyance of the recording paper 3 stops.

Effect of Operation

Because the supply motor 25 is controlled during the rewind operation according to movement of a movable member 27, or more specifically according to change in the tension applied to the recording paper 3 by the movable member 27, the supply motor 25 can be driven efficiently reflecting change in tension during the rewind operation, and the time required for the operation of taking up slack in the recording paper 3 can be shortened. More specifically, when the rewind operation starts without knowing the slack in the recording paper 3, the supply motor 25 is driven at a first velocity V1 at which the paper roll 2 will not rewind the recording paper 3 excessively until the movable member 27 moves from the slack limit position 27B until the position of the movable member 27 reflects the slack in the recording paper 3, the supply motor 25 is then driven at a faster second velocity V2 to rotate the paper roll 2 and return the movable member 27 to the target position 27C. The rewind operation can therefore be completed in less time than if the supply motor 25 is driven continuously at the speed (first velocity V1) at which the paper roll 2 will not overwind the recording paper 3.

Providing a large area for movement of the movable member 27 to prevent damage to the movable member 27 or other parts in the event the paper roll 2 overwinds the recording paper 3 is also not necessary, and the printer 1 case is prevented from becoming large. Furthermore, because the rewind operation takes only a short time, a drop in throughput can be suppressed even if the rewind operation executes every time before printing starts. Because a drop in throughput can therefore be prevented, there is no need to execute the process of removing slack when not printing, and power consumption can be suppressed compared with a configuration that also takes up slack when not printing.

In this example, the setting of the target rewind position changes each time the gain G changes, thereby changing the gap distance L and the control amount D of the supply motor 25. The speed of the supply motor 25 immediately after the gain G changes can therefore be adjusted based on where the target rewind position is set. A great increase in the speed of the supply motor 25 immediately after gain G changes can also be suppressed, and the supply motor 25 can be smoothly controlled.

Other Embodiments

In the rewind operation described above, the gain G changes between a first gain G1 and a second gain G2, but the gain G may be adjusted to any of three or more gain G settings, and the gain G change between these plural settings based on the position of the movable member 27. For example, a first gain of a first proportional constant may be used when the rewind operation starts, changed to a second gain G2 of a second proportional constant greater than the first proportional constant when the position of the movable member 27 changes, and when the position of the movable member 27 then changes again, the gain G may be changed to a third gain of a third proportional constant that is greater than the second proportional constant to drive the supply motor 25 and set the movable member 27 to the target position 27C. In this event, if the target rewind position is changed to a position where the gap distance L to the position of the movable member 27 becomes shorter each time the gain G changes, the speed of the supply motor 25 can be increased while keeping the torque output of the supply motor 25 sufficient to move the movable member 27 in resistance to the force of the compression spring 30, and the time required for the rewind operation can be shortened. Furthermore, because the speed of the supply motor 25 immediately after the gain G changes according to the target rewind position can be adjusted, great change in the speed of the supply motor 25 can be suppressed, and the supply motor 25 can be controlled smoothly.

Furthermore, the supply motor 25 in this example is driven by PWM control, but the drive method of the supply motor 25 is not so limited and any suitable method may be used. If the supply motor is a motor driven by a drive method other than PWM drive, the method of controlling the supply motor 25 before the position of the movable member 27 changes (information equivalent to the first gain G1 of this embodiment), and the method of controlling the supply motor 25 after the position of the movable member 27 changes (information equivalent to the second gain G2 in this embodiment), will be information corresponding to the drive method of the supply motor 25.

Furthermore, the supply motor 25 is controlled based on the gap distance L and gain G in the foregoing example, but if the movable member 27 moves from the slack limit position 27B, the position to which it moves thereafter will reflect the slack in the recording paper 3. Therefore, after the movable member 27 moves from the slack limit position 27B, driving the supply motor 25 thereafter may change to PID control based on the positional deviation of its position to the target position 27C to set the movable member 27 to the target rewind position.

In the above example, the printer control unit 34 starts printing the print data without delay when the rewind operation ends, but the printer control unit 34 (conveyance control unit) may start printing the print data after a predetermined delay passes from the when the rewind operation ends. More specifically, conveyance of the recording paper 3 by the conveyance mechanism 12 may start after waiting for the tension on the recording paper 3 to stabilize after the rewind operation ends.

In the above example, the gain changing unit 43 changes the setting of the target rewind position simultaneously with changing the gain G, but the rewind operation can be controlled by changing only the gain G without changing the setting of the target rewind position.

The supply motor 25 is driven by PID control during conveyance of the recording paper 3 in the above example, but the supply motor 25 may be driven by PD control or PI control.

The movable member 27 in this embodiment of the invention pivots around an axis of rotation C, but a configuration in which the movable member 27 moves linearly following a change in the tension on the recording paper 3 is also conceivable. Yet further, the conveyance mechanism 12 in the above example drives the conveyance belt 15 by the conveyance motor 21 to convey the recording paper 3, but the conveyance mechanism could alternatively convey the recording paper by driving a conveyance roller by means of the conveyance motor.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A roll paper conveyance control method of a roll paper conveyance device having a conveyance mechanism for conveying media delivered from a roll, and a supply motor for rotating the roll, comprising:

driving the supply motor to rewind the media onto the roll both as part of a rewind operation and to set roller to a target position; and detecting movement of a movable member, the movable member includes the roller that is configured for contacting the media and a lever attached to the roller, wherein the movable member is configured to move according to variation in tension on the media, while the supply motor is driven in the rewind operation, wherein, the supply motor is driven by PID control based on a positional deviation between the position of the roller and a target position, after the movement of the movable member is detected, and the position deviation is calculated based on the detected movement of the movable member.

2. The roll paper conveyance control method described in claim 1, further comprising:

increasing the rotational velocity of the supply motor after the movement of the movable member is detected.

3. The roll paper conveyance control method described in claim 1, wherein:

the supply motor is driven based on a control amount calculated according to a first gain, the first gain defines a relationship between the positional deviation and the control amount, before the movement of the moveable member is detected the supply motor is driven based on the control amount calculated according to a second gain which defines the relationship between the positional deviation and the control amount; and the control amount at a specific positional deviation calculated based on the second gain is greater than the first gain.

4. The roll paper conveyance control method described in claim 3, wherein:

the first gain is a first proportional constant related to proportional relationship of the positional deviation and the control amount;

the second gain is a second proportional constant related to the positional deviation and the control amount; and the second proportional constant is greater than the first proportional constant.

5. A roll conveyance control method of a roll paper conveyance device having a conveyance mechanism conveying a medium delivered from a roll by driving a conveyance motor, and a supply mechanism rotating the roll by driving a supply motor, the method comprising:

driving the supply motor to rotate the roll and rewind the medium to the roll as a rewind operation;

detecting movement of a movable member that moves according to variation in tension on the medium between the roll and the conveyance motor in a conveyance path;

setting the movable member to a target position by controlling the media supply motor in the rewind operation according to the detected movement of the movable member; and driving the conveyance motor to convey the medium in a direction from the roil to the conveyance mechanism after the movable member set to the target position in the rewind operation, wherein the supply motor is driven by PID control based on a positional deviation between the position of the movable member and a target position, after the movement of the movable member is detected in the rewind operation, and wherein the supply motor is driven by PID control while the conveyance motor is driven to convey the medium in the direction.

6. The roll paper conveyance control method described in claim 5, wherein:

the driving of the conveyance motor is started when a set time passes after the movable member is set to the target position.

* * * * *